US006605163B2

(12) United States Patent
Cozar et al.

(10) Patent No.: US 6,605,163 B2
(45) Date of Patent: Aug. 12, 2003

(54) PROCESS FOR MANUFACTURING A STRIP MADE OF AN FE-NI ALLOY

(75) Inventors: Ricardo Cozar, La Fermete (FR); Jean-Pierre Reyal, Eragny (FR); Pierre Louis Reydet, Gimouille (FR)

(73) Assignee: Imphy Ugine Precision, Puteaux (FR)

( * ) Notice: Subject to any disclaimer, the term of this patent is extended or adjusted under 35 U.S.C. 154(b) by 0 days.

(21) Appl. No.: 09/938,504

(22) Filed: Aug. 27, 2001

(65) Prior Publication Data

US 2002/0134469 A1 Sep. 26, 2002

(30) Foreign Application Priority Data

Jan. 24, 2001 (FR) ..... 01 00971

(51) Int. Cl.[7] ..... C22C 38/08; C21D 8/00

(52) U.S. Cl. ..... 148/336; 148/621; 148/652; 148/675

(58) Field of Search ..... 148/621, 651, 148/652, 654, 661, 336, 442, 426; 420/94, 95, 96, 97, 581

(56) References Cited

U.S. PATENT DOCUMENTS 5,520,755 A * 5/1996 Inoue et al. ..... 148/624

5,688,471 A * 11/1997 Smith et al. ..... 420/94

* cited by examiner

*Primary Examiner*—Deborah Yee
(74) *Attorney, Agent, or Firm*—Sughrue Mion, PLLC

(57) ABSTRACT

Process for manufacturing a strip made of an Fe—Ni alloy of the "γ' and/or γ" structural hardening" type, the thermal expansion coefficient between 20° C. and 150° C. of which is less than $7\times10^{-6}$/K, in which a hot strip is manufactured either by hot rolling a semi-finished product or by direct casting of a thin strip which is optionally lightly hot-rolled, and the hot strip is subjected to a softening annealing operation consisting of a soak between 950° C. and 1200° C. followed by rapid cooling and optionally a pickling operation, in order to obtain a softened strip; a cold-worked strip is manufactured by cold rolling the said softened strip, with a reduction ratio of greater than 5%; and the cold-worked strip is subjected to a recrystallization annealing operation in an inert or reducing atmosphere, carried out either on the run with a residence time between 900° C. and 1200° C. of between 30 s and 5 min, or statically with a soak at a temperature of between 900° C. and 1050° C. for a time of between 15 min to 5 h, followed by cooling down to a temperature below 500° C. at a cooling rate sufficient to prevent the formation of hardening precipitates. Strip made of an Fe—Ni alloy.

16 Claims, No Drawings

PROCESS FOR MANUFACTURING A STRIP MADE OF AN FE-NI ALLOY

BACKGROUND OF THE INVENTION

The present invention relates to the manufacture of a strip made of an Fe—Ni alloy of the "γ' and/or γ" structural hardening" type and to the strip obtained.

To manufacture articles such as tensioned shadow mask support frames for colour television tubes, strips made of an Fe—Ni alloy of the "γ' and/or γ" structural hardening" type, having a low expansion coefficient and a high yield strength after hardening, are used.

The process for manufacturing these frames comprises many operations. First of all, parts are cut from a softened strip, which parts are bent and then assembled by welding so as to obtain a frame. A series of operations are carried out on this frame, intended to blacken it, by forming a layer of oxides, and to harden it and to fasten the shadow mask. During these operations, the frame is subjected to forces at high temperature which may cause creep, possibly resulting in unacceptable deformation or even fracture.

SUMMARY OF THE INVENTION.

It is the object of the present invention to provide a process which makes it possible to obtain a strip made of an Fe—Ni alloy of the "γ' and/or γ" structural hardening" type which exhibits good creep strength and which, preferably, has good blackenability.

For this purpose, the subject of the invention is a process for manufacturing a strip made of an Fe—Ni alloy of the "γ' and/or γ" structural hardening" type, the thermal expansion coefficient between 20° C. and 150° C. of which is less than $7\times10^{-6}$/K, in which:

- a hot strip is manufactured either by hot rolling a semi-finished product or by direct casting of a thin strip which is optionally lightly hot-rolled, and the hot strip is subjected to a softening annealing operation consisting of a soak between 950° C. and 1200° C. followed by rapid cooling and optionally a pickling operation, in order to obtain a softened strip;
- a cold-worked strip is manufactured by cold rolling the said softened strip, with a reduction ratio of greater than 5%; and
- the cold-worked strip is subjected to a recrystallization annealing operation in an inert or reducing atmosphere, carried out either on the run with a residence time between 900° C. and 1200° C. of between 30 s and 5 min, or statically with a soak at a temperature of between 900° C. and 1050° C. for a time of between 15 min to 5 h, followed by cooling down to a temperature below 500° C. at a cooling rate sufficient to prevent the formation of hardening precipitates.

The invention also relates to an unhardened strip made of an Fe—Ni alloy of the "γ' and/or γ" structural hardening" type, the thermal expansion coefficient between 20° C. and 150° C. of which is less than $7\times10^{-6}$/K, which after hardening by the precipitation of γ' and/or γ" phases has a yield strength greater than 600 MPa and a creep resistance at 600° C. for 1 hour at 350 MPa characterized by a creep strain of less than 0.2%, and at least one side of which optionally includes a uniform gold-coloured layer.

DETAILED DESCRIPTION OF THE INVENTION

The invention will now be described in greater detail but in a non-limiting manner.

Fe—Ni alloys of the "γ' and/or γ" structural hardening" type are alloys whose main elements are iron and nickel and which furthermore include one or more elements such as titanium or aluminium, which can form precipitates of the γ' intermetallic phase, or such as niobium or tantalum, which can form precipitates of the γ" intermetallic phase. These precipitates are hardening.

Other elements may be present in limited amounts, such as chromium, molybdenum, tungsten, zirconium, carbon, silicon and manganese, together with impurities resulting from the smelting. The contents of these various elements may be chosen so as to adjust the various properties of the alloy, such as its expansion coefficient and its hardness after hardening.

Such an alloy may be in the "softened state", that is to say having a limited yield strength when the hardening elements are in solution. This can be obtained by a softening annealing operation consisting of a soak at a high enough temperature, preferably between 950° C. and 1200° C., and better still between 1000° C. and 1075° C., preferably for a time of between 1 minute and 5 minutes. This soak must be followed by rapid cooling down to a temperature below 500° C., and for example down to room temperature. Preferably, the cooling between the softening annealing temperature and 500° C. must be carried out in a time of less than 5 minutes, and better still less than 4 minutes. Even better, the cooling between the annealing temperature and 400° C. must be carried out in a time of less than 5 minutes. The annealing temperature must be high enough to prevent the formation of cellular γ' precipitates at the grain boundaries, but not too high in order, on the one hand, to prevent the carbides from going into solution and to prevent them from precipitating at the grain boundaries and, on the other hand, to prevent grain coarsening. This softening annealing is preferably carried out in a protective atmosphere consisting, for example, of a hydrogen/nitrogen mix having a dew point below −40° C., and preferably below −45° C. These treatment conditions are those to which reference will be made below, when a softening treatment will be considered.

The hardening is obtained by a hardening heat treatment above approximately 500° C., intended to precipitate the hardening phases. Preferably, this treatment is carried out below 800° C., for example at around 750° C., for approximately 30 minutes.

To manufacture a tensioned shadow mask support frame for colour television tubes, the composition is chosen so that the thermal expansion coefficient between 20° C. and 150° C. is less than $7\times10^{-6}$/K, and preferably less than $6\times10^{-6}$/K and better still less than $5\times10^{-6}$/K. The composition is also chosen so that the yield strength in the hardened state is greater than 600 MPa and better still greater then 700 MPa.

To do this, the chemical composition, in per cent by weight, is for example such that:

$40\% \leqq Ni+Co+Cu \leqq 45\%$ $0\% \leqq Co \leqq 5\%$ $0\% \leqq Cu \leqq 3\%$ $0.5\% \leqq Ti \leqq 4\%$ $0.02\% \leqq Al \leqq 1.5\%$ $0\% \leqq Nb+Ta/2 \leqq 6\%$ $0\% \leqq Cr \leqq 3\%$ $0\% \leqq Zr \leqq 1\%$ $0\% \leqq Mo+W/2 \leqq 3\%$ $C \leqq 0.1\%$ $Si \leqq 0.7\%$ Mn≦0.7%

S≦0.02%

P≦0.04%

0%≦B≦0.005% the balance being iron and impurities resulting from the smelting.

Preferably, the chemical composition is such that:

40.5%≦Ni+Co+Cu≦44.5%

0%≦Co≦5%

0%≦Cu≦3%

1.5%≦Ti≦3.5%

0%≦Nb+Ta/2≦1%

0.05%≦Al≦1%

0%≦Cr≦0.5%

0%≦Zr≦0.5%

0%≦Mo+W/2≦0.1%

C≦0.05%

Si≦0.5%

Mn≦0.5%

S≦0.01%

P≦0.02%

0.0005%≦B≦0.003%.

In general, the nickel content is adjusted according to the titanium, aluminium, niobium and tantalum contents in such a way that the nickel content of the matrix after the intermetallic compounds have precipitated makes it possible to obtain the desired thermal expansion coefficient.

Manufacture of the strip starts with the smelting of the alloy in an electric arc furnace with in-ladle refining, or in an induction furnace. A liquid alloy is thus obtained.

The liquid alloy may be cast directly in the form of a semi-finished product, such as an ingot, a bloom or a billet, or else in the form of a strip obtained by thin-strip direct casting, for example by twin-roll casting.

The liquid alloy may also, preferably, be cast in the form of a remelting electrode which is remelted either by electroslag remelting (ESR process) or by vacuum arc remelting (VAR process) in order to obtain a semi-finished product. This remelting has the advantage of giving a more homogeneous metal exhibiting little segregation and few defects, such as oxidized inclusions.

The semi-finished product is reheated and, preferably, maintained between 1100° C. and 1300° C. for 2 to 50 hours so as to homogenize it, and then it is hot rolled at a temperature of between 900° C. and 1300° C. in order to obtain a hot strip having a thickness of between approximately 3 mm and 5 mm (the choice of thickness depends on the thickness of the strip which it is desired finally to obtain).

When the alloy is cast directly in the form of a thin strip, this may or may not be slightly hot rolled.

In all cases, the strip is then softened by a softening annealing operation followed by rapid cooling as indicated above, after which it is pickled. A softened strip is thus obtained.

The softened strip is then cold rolled in one or more operations separated by softening annealing operations, preferably under the conditions indicated above. The final cold-rolling operation must be carried out with a reduction ratio of greater than 5%, and preferably less than 90%, so as to obtain a cold-worked strip.

Before the cold rolling, or between two successive cold-rolling operations, or after the cold rolling, the strip may be abraded on one or both of its sides, for example by polishing, so as to remove any surface layer depleted in titanium by the preceding high-temperature soaks.

The strip thus obtained is then subjected to a recrystallization annealing operation in an inert or reducing atmosphere carried out either on the run, with a residence temperature between 900° C. and 1200° C. of between 30 s and 5 min, or statically with a soak at a temperature of between 900° C. and 1050° C. for a time of between 15 min to 5 h, followed by cooling down to a temperature below 500° C. at a cooling rate sufficient to prevent the formation of hardening precipitates. Preferably, the annealing is carried out under the softening annealing conditions described above. Preferably, the atmosphere consists of 20% to 30% nitrogen and 80% to 70% hydrogen, preferably with a dew point below −40° C. and better still below −45° C. For example, the atmosphere may contain 25% nitrogen and 75% hydrogen, approximately.

This recrystallization treatment carried out on a strip having a cold-working ratio of greater than 5% makes it possible to obtain, in the hardened state, a creep resistance characterized by a strain of less than 0.2% after being held for 1 hour at 600° C. under a stress of 350 MPa. This creep resistance allows the tensioned shadow mask support frames to be manufactured correctly.

It should be noted that, in order to obtain good creep resistance, it is desirable for the temperature of the recrystallization annealing to be above 1000° C. and preferably close to 1050° C. This is because, for a titanium content of approximately 2.6% and an aluminium content of approximately 0.21%, the creep strain at 350 MPa at 600° C. after 1 hour is 0.28% for an annealing temperature of 950° C., 0.14% for a temperature of 1010° C., 0.06% for a temperature of 1060° C. and 0.03% for a temperature of 1100° C.

When one side of the strip has been abraded before the recrystallization annealing, this side has, after the annealing, a uniform gold colour resulting from the formation on the surface of a layer, having a thickness of a few microns, or even less than 1 micron, consisting of compounds such as titanium nitride. This gold-coloured layer has the advantage of facilitating the operation of blackening the frame, carried out during its manufacture.

After softening or recrystallization annealing, the strip may be planished. It is then desirable for the planishing to result in an equivalent cold working of less than 5%. However, it is desirable for this equivalent cold working to be greater than 1% and better still greater than 2%. This cold working improves the creep behaviour. The term "equivalent cold working" is understood to mean cold working for which, by a tensile test on an unplanished softened strip, the same yield strength is obtained as that by a tensile test on the strip after planishing.

Obtained by this process is an unhardened strip made of an Fe—Ni alloy of the "γ' and/or γ" structural hardening" type, the thermal expansion coefficient between 20° C. and 150° C. of which is less than $7\times10^{-6}$/K, characterized in that, after hardening by the precipitation of γ' and/or γ" phases, it has a yield strength greater than 600 MPa and a creep resistance at 600° C. for 1 hour at 350 MPa characterized by a strain of less than 0.2%, and in that, optionally, at least one side includes a uniform gold-coloured layer. This strip is particularly suitable for the manufacture of a tensioned shadow mask support frame for colour television tubes.

As an example, strips made of a hardened Fe—Ni alloy were manufactured according to the invention, the chemical composition of which comprised, in per cent by weight:

| Ni | Cu | Ti | Al | Nb | Mo | C | Si | Mn | S | P | B |
|---|---|---|---|---|---|---|---|---|---|---|---|
| 42.85 | 0.18 | 2.48 | 0.251 | 0 | 0.08 | 0.006 | 0.1 | 0.15 | 0.0009 | 0.005 | 0.0012 |

The balance is iron and impurities, or trace elements resulting from the smelting.

The alloy was smelted in a VIM furnace and then remelted by ESR in order to obtain ingots which were hot rolled after reheating to 1100° C. in order to obtain two hot strips A and B of 4 mm in thickness. These strips were pickled and annealed at 1050° C. for 4 minutes and then cooled to below 400° C. in 280 seconds. The strips thus softened were cold rolled in order to obtain a thickness of 1.5 mm, which corresponds to a reduction ratio of 62%. The strips were then polished on one side and then were annealed at 1050° C. for 4 minutes and cooled to below 400° C. in 190 seconds.

Strip A was cold planished by rolling in a planishing mill without tensioning, resulting in an equivalent cold working of 2.5%, and then it was subjected to a hardening treatment by a soak at 750° C. for 30 minutes.

Strip B was cold planished by rolling in a planishing mill with tensioning, resulting in an equivalent cold working of 5%, and then it was subjected to a hardening treatment by a soak at 750° C. for 30 minutes.

The mechanical properties of strips A and B were measured before and after hardening, together with the creep strain at 600° C. under a load of 350 MPa for 1 hour, after hardening.

The results are as follows:

In the softened state before planishing (A and B)

| E (GPa) | $R_{p0.2}$ (MPa) | $R_m$ (MPa) | $A_u$ (%) | $A_t$ (%) |
|---|---|---|---|---|
| 119 | 318 | 618 | 26.3 | 44.9 |

E = Young's modulus; $R_{p0.2}$ = yield strength; $R_m$ = tensile strength; $A_u$ = uniform elongation; $A_t$ = total elongation; after planishing, but before hardening:

| | E (GPa) | $R_{p0.2}$ (MPa) | $R_m$ (MPa) | $A_u$ (%) | $A_t$ (%) |
|---|---|---|---|---|---|
| A | 102 | 362 | 645 | 25.7 | 41.8 |
| B | 166 | 389 | 658 | 24.8 | 39.1 |

after planishing, but after hardening:

| | E (GPa) | $R_{p0.2}$ (MPa) | $R_m$ (MPa) | $A_u$ (%) | $A_t$ (%) |
|---|---|---|---|---|---|
| A | 170 | 980 | 1256 | 10.5 | 17.9 |
| B | 174 | 1000 | 1271 | 9.4 | 18.5 |

These results show in particular that light cold working favours hardening;

creep strain at 600° C. under a load of 350 MPa for 1 hour:

A: 0.005%

B: −0.13%

It may be seen that the creep strain in the case of strip B is negative. This results from the fact that, because of the approximately 5% cold working, the 600° C. soak results in a slight additional hardening which is accompanied by a reduction in section of the strip.

The thermal expansion coefficient of the strips was less than $7\times10^{-6}$/K.

What is claimed is:

1. Process for manufacturing a strip made of a γ' and/or γ" structural hardenable Fe—Ni alloy, the thermal expansion coefficient between 20° C. and 150° C. of which is less than $7\times10^{-6}$/K, in which:

a hot strip is manufactured either by hot rolling a semi-finished product or by direct casting of a thin strip which is optionally lightly hot-rolled, and the hot strip is subjected to a softening annealing operation consisting of a soak between 950° C. and 1200° C. followed by rapid cooling and optionally to a pickling operation, in order to obtain a softened strip;

a cold-worked strip is manufactured by cold rolling the said softened strip, with a reduction ratio of greater than 5%; and the cold-worked strip is subjected to a recrystallization annealing operation in an inert or reducing atmosphere, carried out either on the run at a temperature between 900° C. and 1200° C. with a residence time of between 30 s and 5 mm, or statically with a soak at a temperature of between 900° C. and 1050° C. for a time of between 15 mm to 5 h, followed by cooling down to a temperature below 500° C. at a cooling rate sufficient to prevent the formation of hardening precipitates, wherein the temperature of the softening annealing carried out after the hot rolling is between 1000° C. and 1075° C.

2. Process according to claim 1, characterized in that the temperature of the recrystallization annealing on the run, carried out after the cold rolling, is between 1000° C. and 1075° C.

3. Process for manufacturing a strip made of a γ' and/or γ" structural hardenable Fe—Ni alloy, the thermal expansion coefficient between 20° C. and 150° C. of which is less than $7\times10^{-6}$/K, in which:

a hot strip is manufactured either by hot rolling a semi-finished product or by direct casting of a thin strip which is optionally lightly hot-rolled, and the hot strip is subjected to a softening annealing operation consisting of a soak between 950° C. and 1200° C. followed by rapid cooling and optionally to a pickling operation, in order to obtain a softened strip;

a cold-worked strip is manufactured by cold rolling the said softened strip, with a reduction ratio of greater than 5%; and the cold-worked strip is subjected to a recrystallization annealing operation in an inert or reducing atmosphere, carried out either on the run at a temperature between 900° C. and 1200° C. with a residence time of between 30 s and 5 mm, or statically with a soak at a temperature of between 900° C. and 1050° C. for a time of between 15 mm to 5 h, followed by cooling down to a temperature below 500° C. at a cooling rate sufficient to prevent the formation of hardening precipitates, wherein the cooling time between each of the softening and the recrystallization annealing temperature and 500° C. is less than 5 minutes.

4. Process for manufacturing a strip made of a γ' and/or γ" structural hardenable Fe—Ni alloy, the thermal expansion coefficient between 20° C and 150° C. of which is less than $7\times10^{-6}$/K, in which:

a hot strip is manufactured either by hot rolling a semi-finished product or by direct casting of a thin strip which is optionally lightly hot-rolled, and the hot strip is subjected to a softening annealing operation consisting of a soak between 950° C. and 1200° C. followed by rapid cooling and optionally to a pickling operation, in order to obtain a softened strip;

a cold-worked strip is manufactured by cold rolling the said softened strip, with a reduction ratio of greater than 5%; and the cold-worked strip is subjected to a recrystallization annealing operation in an inert or reducing atmosphere, carried out either on the run at a temperature between 900° C. and 1200° C. with a residence time of between 30 s and 5 mm, or statically with a soak at a temperature of between 900° C. and 1050° C. for a time of between 15 mm to 5 h, followed by cooling down to a temperature below 500° C. at a cooling rate sufficient to prevent the formation of hardening precipitates, wherein the inert or reducing atmosphere in which the recrystallization annealing is carried out consists of 20 to 30% nitrogen and 80% to 70% hydrogen and has a dew point below −40° C.

5. Process for manufacturing a strip made of a γ' and/or γ" structural hardenable Fe—Ni alloy, the thermal expansion coefficient between 20° C. and 150° C. of which is less than $7\times10^{-6}$/K, in which:

a hot strip is manufactured either by hot rolling a semi-finished product or by direct casting of a thin strip which is optionally lightly hot-rolled, and the hot strip is subjected to a softening annealing operation consisting of a soak between 950° C. and 1200° C. followed by rapid cooling and optionally to a pickling operation, in order to obtain a softened strip;

a cold-worked strip is manufactured by cold rolling the said softened strip, with a reduction ratio of greater than 5%; and the cold-worked strip is subjected to a recrystallization annealing operation in an inert or reducing atmosphere, carried out either on the run at a temperature between 900° C. and 1200° C. with a residence time of between 30 s and 5 mm, or statically with a soak at a temperature of between 900° C. and 1050° C. for a time of between 15 mm to 5 h, followed by cooling down to a temperature below 500° C. at a cooling rate sufficient to prevent the formation of hardening precipitates, wherein a planishing operation is furthermore carried out, resulting in an equivalent cold-working ratio of less than 5%.

6. Process according to claim 5, characterized in that the equivalent cold-working ratio caused by the planishing is greater than 2%.

7. Process for manufacturing a strip made of a γ' and/or γ" structural hardenable Fe—Ni alloy, the thermal expansion coefficient between 20° C. and 150° C. of which is less than $7\times10^{-6}$/K, in which:

a hot strip is manufactured either by hot rolling a semi-finished product or by direct casting of a thin strip which is optionally lightly hot-rolled, and the hot strip is subjected to a softening annealing operation consisting of a soak between 950° C. and 1200° C. followed by rapid cooling and optionally to a pickling operation, in order to obtain a softened strip;

a cold-worked strip is manufactured by cold rolling the said softened strip, with a reduction ratio of greater than 5%; and the cold-worked strip is subjected to a recrystallization annealing operation in an inert or reducing atmosphere, carried out either on the run at a temperature between 900° C. and 1200° C. with a residence time of between 30 s and 5 mm, or statically with a soak at a temperature of between 900° C. and 1050° C. for a time of between 15 mm to 5 h, followed by cooling down to a temperature below 500° C. at a cooling rate sufficient to prevent the formation of hardening precipitates, wherein before, during or after the cold rolling, at least one side of the strip is abraded, so as to obtain, after the recrystallization annealing, a uniform gold-coloured layer on said at least one side.

8. Process according to claim 3, characterized in that said semi-finished product consists of an alloy smelted in an electric arc furnace, with in-ladle refining, or in an induction furnace.

9. Process according to claims 8, characterized in that in order to manufacture the said semi-finished product, a remelting electrode is cast which is electroslag-remelted (ESR) or vacuum remelted (VAR).

10. Process according to claim 3, characterized in that the said directly cast thin strip consists of an alloy smelted in an electric arc furnace, with in-ladle refining, or in an induction furnace.

11. Process according to claim 3, characterized in that the chemical composition of the alloy is such that:

$40\% \leqq Ni+Co+Cu \leqq 45\%$ $0\% \leqq Co \leqq 5\%$ $0\% \leqq Cu \leqq 3\%$ $0.5\% \leqq Ti \leqq 4\%$ $0.02\% \leqq Al \leqq 1.5\%$ $0\% \leqq Nb+Ta/2 \leqq 6\%$ $0\% \leqq Cr \leqq 3\%$ $0\% \leqq Zr \leqq 1\%$ $0\% \leqq Mo+W/2 \leqq 3\%$ $C \leqq 0.1\%$ $Si \leqq 0.7\%$ $Mn \leqq 0.7\%$ $S \leqq 0.02\%$ $P \leqq 0.04\%$ $0\% \leqq B \leqq 0.005\%$ the balance being iron and impurities resulting from the smelting.

12. Unhardened strip made of a γand/or γ' structural hardenable Fe—Ni alloy, the thermal expansion coefficient between 200° C. and 1500° C. of which is less than $7\times10^{-6}$/K, characterized in that, after hardening by the precipitation of γ'and/or γ" phases, it has a yield strength greater than 600 MPa and a creep resistance at 600° C. for 1 hour at 350 MPa characterized by a strain of less than 0.2%, and in that at least one side of the strip includes a uniform gold-coloured layer.

13. Strip according to claim 12, characterized in that the chemical composition of the alloy is such that:

$40\% \leqq Ni+Co+Cu \leqq 45\%$ $0\% \leqq Co \leqq 5\%$

0%≦Cu≦3%

0.5%≦Ti≦4%

0.02%≦Al≦1.5%

0%≦Nb+Ta/2≦6%

0%≦Cr≦3%

0%≦Zr≦1%

0%≦Mo+W/2≦3%

C≦0.1%

Si≦0.7%

Mn≦0.7%

S≦0.02%

P≦0.04%

0%≦B≦0.005% the balance being iron and impurities resulting from the smelting.

14. Strip according to claim 13, characterized in that the chemical composition of the alloy is such that:

40.5%≦Ni+Co+Cu≦44.5%

0%≦Co≦5%

0%≦Cu≦3%

1.5%≦Ti≦3.5%

0%≦Nb+Ta/2≦1%

0.05%≦Al≦1%

0%≦Cr≦0.5%

0%≦Zr≦0.5%

0%≦Mo+W/2≦0.1%

C≦0.05%

Si≦0.5%

Mn≦0.5%

S≦0.01%

P≦0.02%

0.0005%≦B≦0.003%.

15. Process according to claim 7, wherein said one side of the strip is abraded by polishing.

16. Process according to claim 8, wherein said semi-finished product is an ingot, a bloom or a billet.

* * * * *